US009761993B2

(12) United States Patent
Larkin

(10) Patent No.: US 9,761,993 B2
(45) Date of Patent: Sep. 12, 2017

(54) BANANA PLUG

(71) Applicant: Westek Electronics, Inc., Watsonville, CA (US)

(72) Inventor: Kevin B. Larkin, Pebble Beach, CA (US)

(73) Assignee: Westek Electronics, Inc., Watsonville, CA (US)

( * ) Notice: Subject to any disclaimer, the term of this patent is extended or adjusted under 35 U.S.C. 154(b) by 0 days.

(21) Appl. No.: 14/991,240

(22) Filed: Jan. 8, 2016

(65) Prior Publication Data

US 2016/0204542 A1 Jul. 14, 2016

Related U.S. Application Data

(60) Provisional application No. 62/110,271, filed on Jan. 30, 2015, provisional application No. 62/101,333, filed on Jan. 8, 2015.

(51) Int. Cl.
*H01R 13/58* (2006.01)
*H01R 4/02* (2006.01)
(Continued)

(52) U.S. Cl.
CPC ..... *H01R 13/582* (2013.01); *H01R 4/02* (2013.01); *H01R 4/023* (2013.01); *H01R 13/17* (2013.01);
(Continued)

(58) Field of Classification Search
CPC ..... H01R 13/582; H01R 4/02; H01R 4/023; H01R 13/17; H01R 13/4538; H01R 13/5825; H01R 13/2421
See application file for complete search history.

(56) References Cited

U.S. PATENT DOCUMENTS 3,235,834 A * 2/1966 O'Keefe ..... H01R 24/52 439/585
4,163,594 A * 8/1979 Aujla ..... H01R 13/6397 439/133

(Continued)

FOREIGN PATENT DOCUMENTS

JP 07-011411 3/1995

OTHER PUBLICATIONS

ISA/KR, International Search Report and Written Opinion for International Application No. PCT/US2016/012556, Apr. 29, 2016, 8 Pages.

*Primary Examiner* — Alexander Gilman

(57) ABSTRACT

A system for containing a strain relief, the system comprising an assembly housing, the assembly housing including: a first outer housing including a connector body; a second outer housing including a rear housing, wherein the first outer housing snaps into the second outer housing and creates a chain of contact points that connect components internal to the assembly housing and prevents internal components from rotating, wherein the assembly housing houses within a banana plug shaft, a strain relief and a solder junction, wherein the solder junction solders a first end of a conductor cable to the banana plug shaft, wherein the first end of the conductor cable is disposed within the assembly housing, and wherein via the chain of contact points, the banana plug shaft presses the strain relief into place and prevents movement of the strain relief and the solder junction.

7 Claims, 7 Drawing Sheets

(51) Int. Cl.
*H01R 13/17* (2006.01)
*H01R 13/453* (2006.01)
*H01R 13/24* (2006.01)

(52) U.S. Cl.
CPC ..... *H01R 13/4538* (2013.01); *H01R 13/5825* (2013.01); *H01R 13/2421* (2013.01)

(56) References Cited

U.S. PATENT DOCUMENTS 4,445,739 A * 5/1984 Wooten ..... H01R 13/4538 439/140
4,944,686 A * 7/1990 Gertz ..... H01R 4/5033 439/175
5,026,301 A * 6/1991 Balyasny ..... H01R 4/2404 29/866
5,142,599 A * 8/1992 Sakurai ..... G02B 6/3847 385/78
5,147,221 A * 9/1992 Cull ..... H01R 24/40 439/585
5,202,949 A * 4/1993 Hileman ..... G02B 6/4478 385/134
5,230,641 A * 7/1993 Wharton ..... H01R 13/2421 439/668
5,318,458 A * 6/1994 Thorner ..... H01R 9/0521 439/427
5,414,346 A * 5/1995 Mohan ..... G01R 1/06788 324/72.5
5,486,123 A * 1/1996 Miyazaki ..... H01R 13/15 439/825
5,704,812 A * 1/1998 Moji ..... H01R 24/58 439/265
5,860,824 A * 1/1999 Fan ..... B60R 11/0217 439/165
5,897,397 A * 4/1999 Yokozawa ..... H01R 24/58 439/668
5,915,995 A * 6/1999 Meyer ..... H01R 24/40 439/585
5,951,337 A * 9/1999 Brake ..... H01R 13/17 439/825
6,010,348 A * 1/2000 Alden ..... H01R 13/506 439/274
6,062,881 A * 5/2000 Ellison ..... H01R 13/4538 439/141
6,176,716 B1 * 1/2001 Mercurio ..... H01R 11/12 439/166
6,193,559 B1 * 2/2001 Weingartner ..... H01R 24/58 439/669
6,406,313 B1 * 6/2002 Victor ..... H01R 27/00 439/175
6,533,617 B1 * 3/2003 D'Addario ..... H01R 13/17 439/669
7,121,872 B1 * 10/2006 Hanks ..... H01R 4/5033 439/427
7,294,022 B1 * 11/2007 Cheng ..... H01R 13/70 200/530
7,326,090 B2 * 2/2008 Cayzac ..... H01R 13/6453 439/378
7,955,144 B2 * 6/2011 Thoerner ..... H01R 4/36 439/825
8,277,237 B1 * 10/2012 Cherish ..... H01R 13/60 439/131
8,410,369 B2 * 4/2013 Kim ..... H01R 13/5841 174/153 G
9,176,285 B2 * 11/2015 Nhep ..... G02B 6/3869
9,246,273 B2 * 1/2016 Montet ..... H01R 13/629
9,331,400 B1 * 5/2016 Bianca ..... H01R 13/03
9,437,952 B2 * 9/2016 Borkar ..... H01R 13/42
2004/0248476 A1 * 12/2004 Zhang ..... H01R 24/28 439/825
2005/0130493 A1 * 6/2005 Thorner ..... H01R 24/20 439/551
2009/0275246 A1 * 11/2009 Strickland, Jr. .... H01R 13/6397 439/738
2014/0113486 A1 * 4/2014 Wild ..... H01R 4/029 439/578

* cited by examiner

BANANA PLUG

CROSS-REFERENCE TO RELATED APPLICATIONS

This application claims priority to and benefit of U.S. provisional patent application 62/101,333, filed Jan. 8, 2015, entitled "BANANA PLUG", by Kevin Larkin, assigned to the assignee of the present application, and is incorporated herein, in its entirety, by reference.

This application claims priority to and benefit of U.S. provisional patent application 62/110,271, filed Jan. 30, 2015, entitled "BANANA PLUG", by Kevin Larkin, assigned to the assignee of the present application, and is incorporated herein, in its entirety, by reference.

Figure 1:
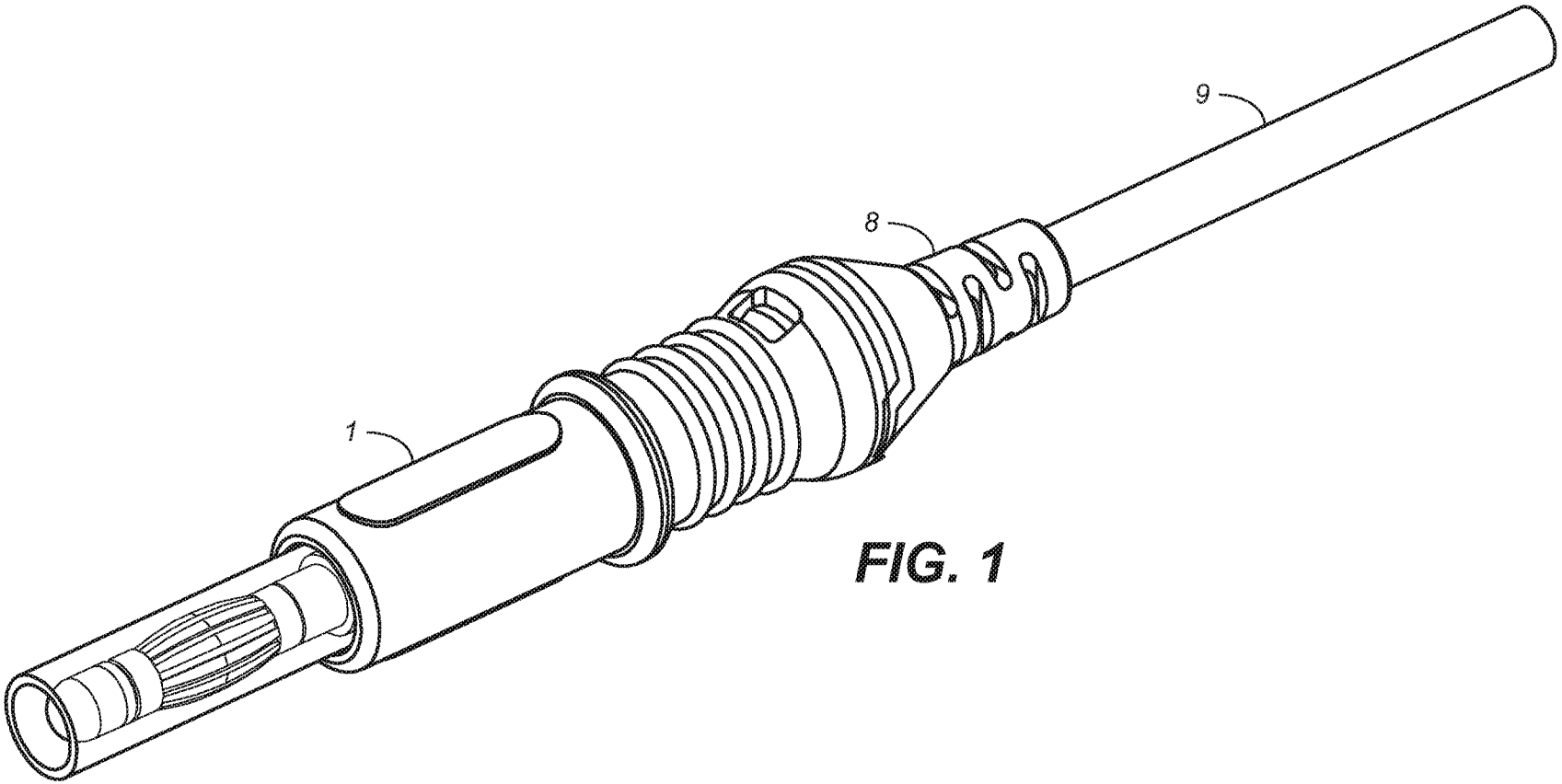
FIG. 1 illustrates an insulated 4 mm banana plug with a retractable shroud assembly, in accordance with an embodiment.

The drawings referred to in this description should not be understood as being drawn to scale unless specifically noted.

Summary of Embodiments

Some embodiments disclosed herein provide a banana connector, that includes: a connector body configured for housing a banana plug shaft; a rear housing configured for attaching to a first end of the connector body and for housing an intermediate portion of a conductor cable, wherein the intermediate portion is between a first end and a second end of the conductor cable; a solder junction comprising a first end of the conductor cable being soldered to the banana plug shaft; a strain relief configured for attaching to an interior of the rear housing; a strain relief locking mechanism configured for holding to the intermediate portion of the conductor cable and securing the first end of the conductor cable in position, wherein the strain relief locking mechanism isolates movement of the second end of the conductor cable from the solder junction. It should be appreciated that while the discussion herein focuses on a banana plug having a size of 4 mm, other banana plugs, in accordance with various embodiments, may be of a 2 mm or 3 mm size.

In some embodiments, the banana connector further includes: a retractable shroud disposed on an exterior of the first end of the connector body, wherein the retractable shroud is spring loaded and covers exposed contact when the banana plug is removed from a mating jack.

In some embodiments, the strain relief is fixed into position within the rear housing when the strain relief locking mechanism holds the intermediate portion of the conductor cable in place. In one embodiment, the strain relief locking mechanism includes winged sections which are inserted into a recessed rear housing strain relief locking feature. Once inserted into the recessed rear housing strain relief locking feature, the strain relief becomes fixed to the rear housing.

In some embodiments, the strain relief locking mechanism includes: a pinching mechanism configured for retainably pinching and deforming the intermediate portion of the conductor cable. The pinching mechanism pushes into the conductor cable, thereby deforming it to some extent from its original shape, and also firmly holds the conductor cable in place, despite any pulling or twisting of one end of the conductor cable. In some embodiments, the conductor cable of the banana connector is insulated. Thus, the strain relief locking mechanism accommodates the size of an insulated conductor cable when retainably pinching the intermediate portion of the conductor cable.

In some embodiments, the banana plug shaft includes: a locking feature configured to cooperate with a connector body locking feature such that the banana shaft is fixed into position within the conductor body.

In some embodiments, the connector body of the banana plug is attached to the rear housing set via a rear housing snap lock feature and a connector body snap lock feature.

Some embodiments disclosed herein provide a system for containing a strain relief, the system comprising an assembly housing, the assembly housing comprising: a first outer housing comprising a connector body; a second outer housing comprising a rear housing, wherein the first outer housing snaps into the second outer housing and creates a chain of contact points that connect components internal to the assembly housing and prevents internal components from rotating, wherein the assembly housing houses within a banana plug shaft, a strain relief and a solder junction, wherein the solder junction solders a first end of a conductor cable to the banana plug shaft, wherein the first end of the conductor cable is disposed within the assembly housing, and wherein via the chain of contact points, the banana plug shaft presses the strain relief into place and prevents movement of the strain relief and the solder junction.

Description of Embodiments

Reference will now be made in detail to embodiments, examples of which are illustrated in the accompanying drawings. While the technology will be described in conjunction with various embodiment(s), it will be understood that they are not intended to be limited to these embodiments. On the contrary, the present technology is intended to cover alternatives, modifications and equivalents, which may be included within the spirit and scope of the various embodiments as defined by the appended claims.

Furthermore, in the following detailed description, numerous specific details are set forth in order to provide a thorough understanding of embodiments. However, embodiments may be practiced without these specific details. In other instances, well known methods, procedures, components, and circuits have not been described in detail as not to unnecessarily obscure aspects of embodiments.

The discussion that follows will begin with a brief description of the conventional banana plug and the problems associated therewith. The discussion will continue then with a brief overview of the present technology that resolves these problems. The discussion continues with a detailed description of the present technology, with reference to FIGS. 1-6*b*.

Convention Banana Plug

A banana connector (commonly, "banana plug" for the male, "banana socket" or "banana jack" for the female) is a single-wire (one conductor) electrical connector used for joining wires to equipment. The term "4 mm connector" is also used, especially in Europe, although not all banana connectors will mate with 4 mm parts. The banana plug is typically a four-leafed spring tip that fits snugly into the banana jack. The banana plugs are frequently used to terminate patch cords for electronic test equipment. They are also often used as the banana plugs on the cables connecting the amplifier to the loudspeakers in hi-fi sound systems.

Banana plugs are an inexpensive and flimsy type of banana connector generally found on lower quality, lower cost test sets like volt meters. There is a push to reduce costs on high end test sets and test equipment that is generally used in the outside environment as well as the inside environment. The area of high quality cable and connectors has been targeted. The migration of the banana plug into this area has occurred to act as a quick change or quick disconnect on expensive clips and probes. The use of the banana plug can reduce the cost of buying additional complete cords with each of these banana plug ends. The problem that occurs with this product is that the banana plug and cable assembly has not been constructed to meet the demands of the environment they are used in. Light weight construction and the lack of plug prong insulation, until recently, have made this product a poor contender.

Recently the addition of a protective retracting insulation shroud/sleeve has brought a major improvement. Insulated 4 mm banana plugs with retractable shrouds are used to meet safety standards such as CE and UL, and protect the user from accidental electrical shock. The retractable shroud is spring loaded and covers the exposed contact when the banana plug is removed from the mating banana jack. However, the addition of this sleeve reduces the amount of room internal to the connector assembly that would allow for a conventional strain relief.

Conventional strain reliefs are generally in the form of a clamp type that is crimped around a cable to prevent twisting and pulling action on the solder junction which prevents premature failure and fatigue to the cable assembly. Room inside the handle where strain reliefs are commonly found is generally sized to allow for different size cables and clamps. This area of the plug body is generally found to be bulky and cumbersome. The reason being is how the strain relief is secured and positioned. The conventional 4 mm banana plug with retractable shroud designs rely on the solder or screw type clamp connection between a conductor cable and the connector to provide the strength of assembly. The problem with this conventional design is that the cable jacket is not secured with respect to the cable termination point, leaving the termination point vulnerable to failure when cable is twisted or pulled on during normal use.

Brief Overview of Present Technology

Embodiments of the present technology address the problem regarding the lack of room for allowing a conventional type strain relief. Embodiments also create a simple and streamlined way to assemble and contain a strain relief that will provide the most reliability without the need for screws or threads. Embodiments create a rugged and reliable plug-in tool that can provide higher rates of electrical connection and disconnection cycles that has never before been achievable. Further, embodiments described herein prevent damage to the connector solder junction by adding a supplemental strain relief feature that restricts movement at the solder junction.

Detailed Description of Present Technology

The Insulated 4 mm banana plug with a retractable shroud assembly will be described with reference to FIG. 1, in accordance with an embodiment. However, it should be appreciated that the present invention also pertains to embodiments of banana plugs having a size other than 4 mms, including, but not limited to, 2 mm banana plugs and 3 mm banana plugs.

The components of FIG. 1 will be described with reference to FIG. 2. FIG. 2 components include, in accordance with an embodiment, connector body 1, retractable shroud 2, insulator tip 3, contact spring 4, retractable shroud spring 5, 4 mm banana plug shaft 6 (It should be appreciated that the present invention also pertains to embodiments of banana plugs having a size other than 4 mms, including, but not limited to, 2 mm banana plugs and 3 mm banana plugs.), strain relief 7 (in one embodiment, referred to as a strain relief "crimp"), rear housing 8, and one insulated conductor cable 9.

Figure 2:
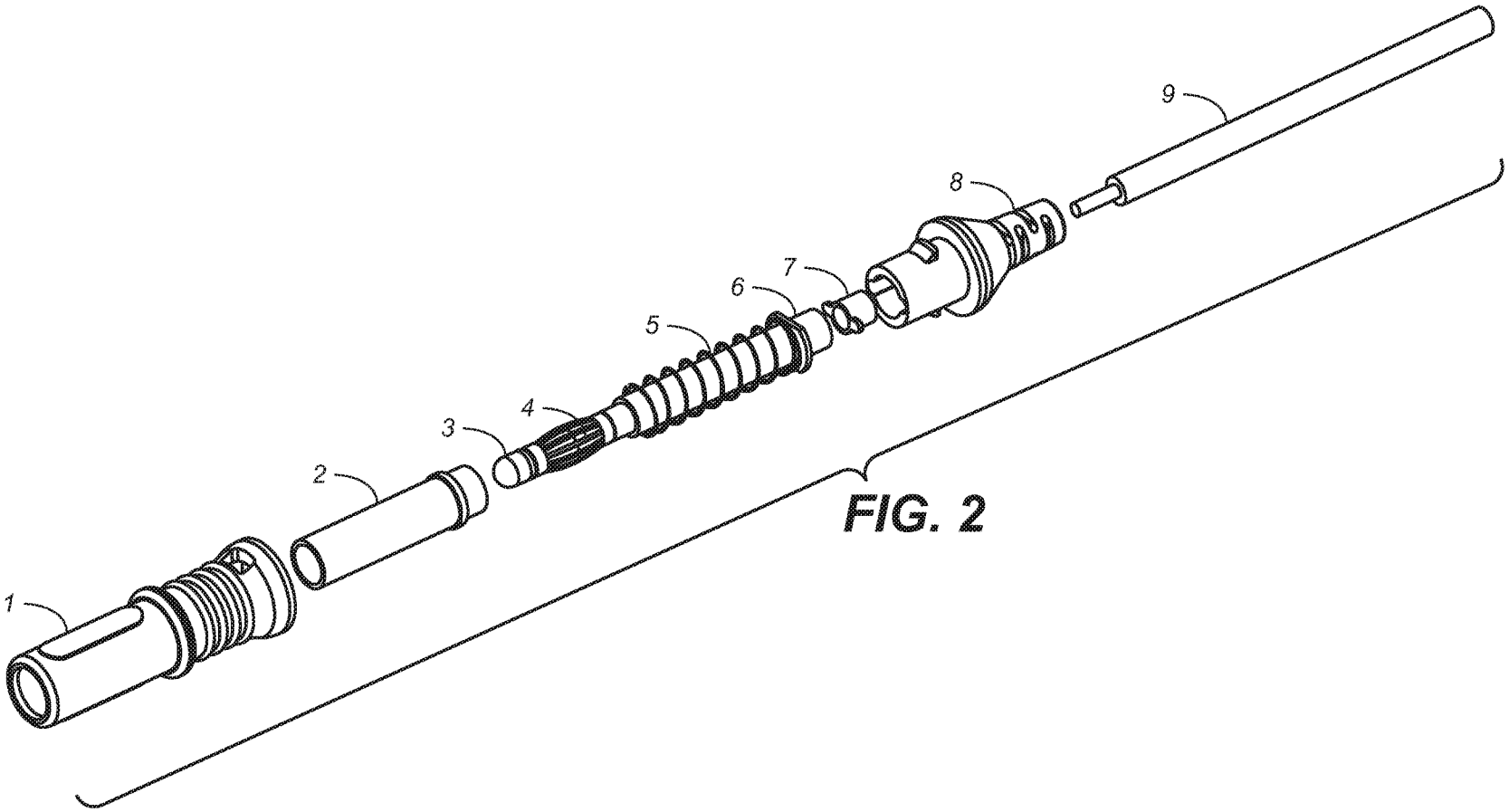
FIG. 2 is an exploded view of FIG. 1, in accordance with an embodiment.
Figure 3:
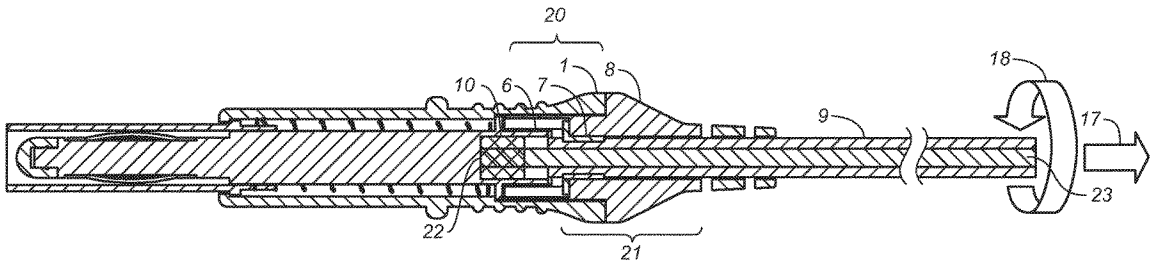
FIG. 3 is a section view that details the internal layout of FIG. 1, in accordance with an embodiment.

FIG. 3 is a section view that details the internal layout of FIG. 1 in accordance with an embodiment. FIG. 3 includes solder junction 10, and elements 1, 7 and 8 to aid in the description of embodiments. According to FIG. 3, the internal layout of connector depicts solder junction 10. The strain relief 7 in conjunction with connector body 1, 4 mm banana plug shaft 6, and rear housing 8 provide a means of securing the one conductor cable 9 in position to prevent damage to solder junction 10. Strain relief 7, when crimped onto one conductor cable 9, deforms one conductor cable 9 jacket there for providing a mechanical lock. When one conductor cable 9 is pulled or twisted as indicated by the arrows 17 and 18, strain relief 7 isolates movement preventing damage to solder junction 10.

Figure 4A:
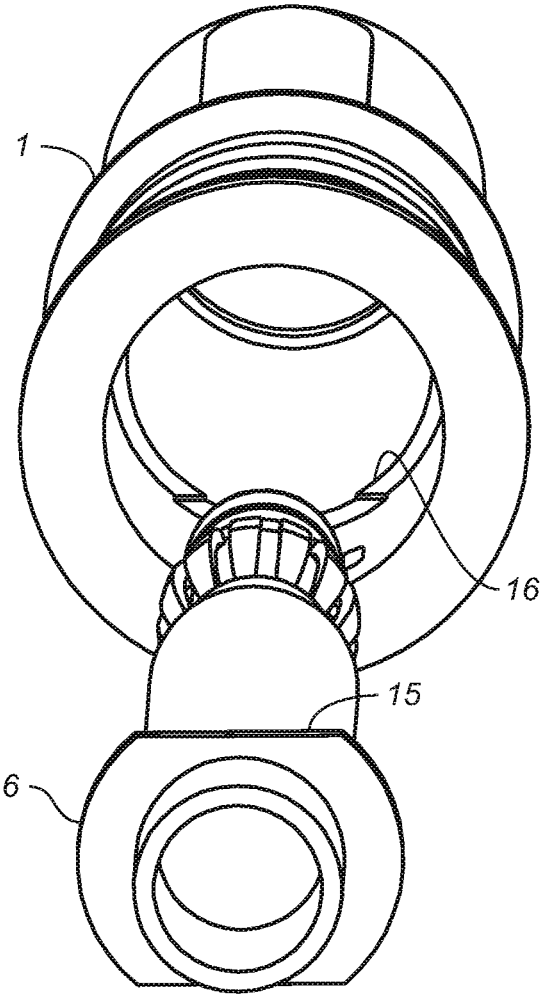
FIG. 4*a* illustrates the connector body, the 4 mm banana plug shaft and the locking features of FIG. 3, in accordance with an embodiment.
Figure 4B:
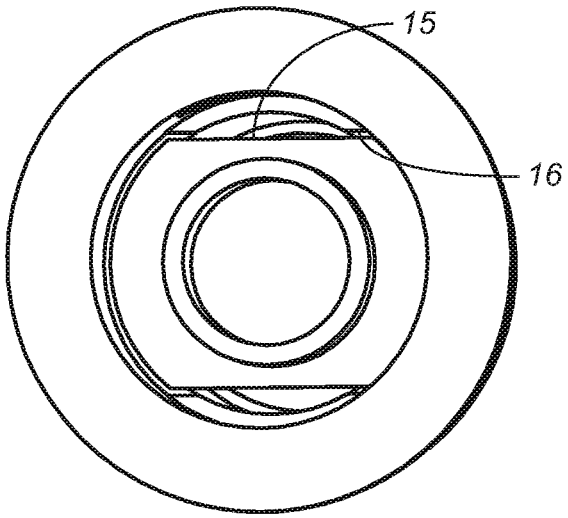
FIG. 4*b* illustrates the locking features, in operation, shown in FIG. 4*a*, in accordance with an embodiment.

FIGS. 4*a* and 4*b* are detail views of connector body 1 and 4 mm banana plug shaft 6 (It should be appreciated that the present invention also pertains to embodiments of banana plugs having a size other than 4 mms, including, but not limited to, 2 mm banana plugs and 3 mm banana plugs.) depicting the locking features, 15 (in one embodiment, but not limited to such, a flat edge) and 16 (in one embodiment, but not limited to such, a form fitted recess), in accordance with an embodiment. FIG. 4*a* detail view of 4 mm banana plug shaft 6 and connector body 1 depicts the form fitted recess 16 in the connector body 1 where flat edge feature 15 of 4 mm banana plug shaft 6 fits in to eliminate axial twisting to the solder junction 10. FIG. 4*b* detail view shows flat edge feature 15 and form fitted recess 16 in a seated position within connector body 1, in accordance with an embodiment. When the banana plug shaft 6 is inserted into the locking feature 15, the banana plug shaft 6 becomes fixed, in that it is not rotatable, in accordance with an embodiment.

Figure 4C:
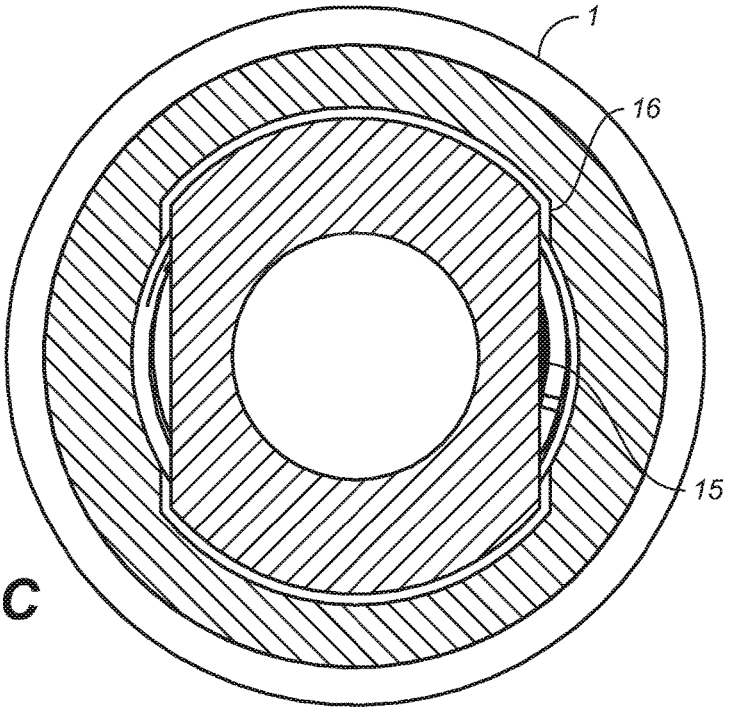
FIG. 4*c* illustrates the locking features, in operation, shown in FIG. 4*a*, in accordance with an embodiment.
Figure 4D:
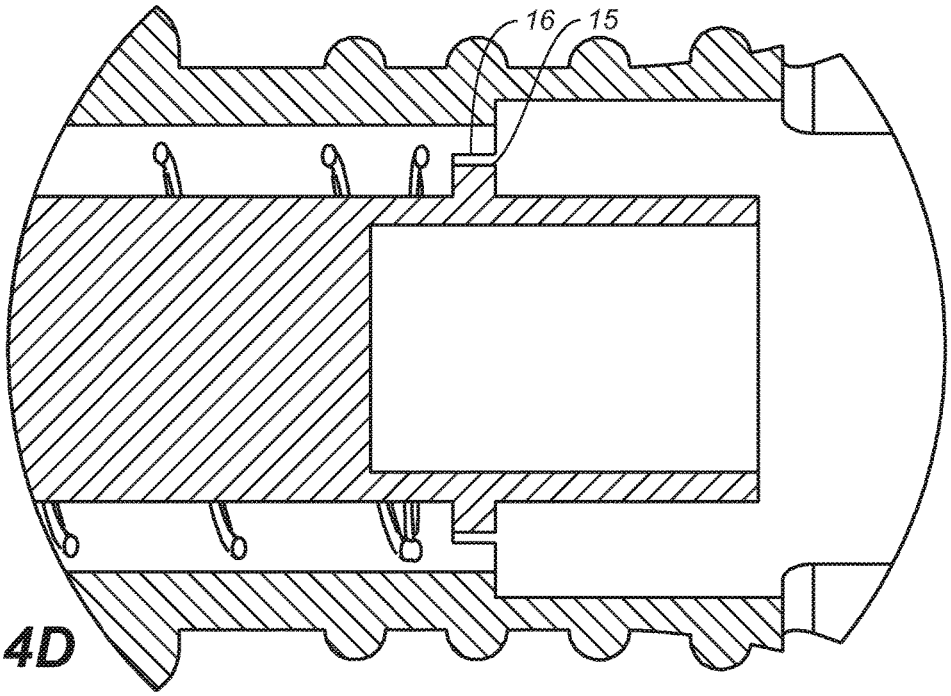
FIG. 4*d* illustrates the locking features of FIG. 4*a* and the flat edge feature of FIG. 6*a* fit into the form fitted recess, in accordance with an embodiment.

FIGS. 4*c* and 4*d* are further detail views of connector body 1 and 4 mm banana plug shaft 6 depicting the locking features 15 and 16, in accordance with an embodiment. (It should be appreciated that the present invention also pertains to embodiments of banana plugs having a size other than 4 mms, including, but not limited to, 2 mm banana plugs and 3 mm banana plugs.) The FIG. 4*c* detail view of the 4 mm banana plug shaft 6 and connector body 1 depicts the form fitted recess 16 in the connector body 1 wherein the flat edge feature 15 of 4 mm banana plug shaft 6 fits into the form fitted recess 16. Upon such a fit, the banana plug shaft 6 is unable to axially twist. FIG. 4*d* shows the flat edge feature 15 of 4 mm banana plug shaft 6 fit into the form fitted recess 16. It can be seen, through such a fit, that the banana plug shaft 6 may not move axially.

Figure 5A:
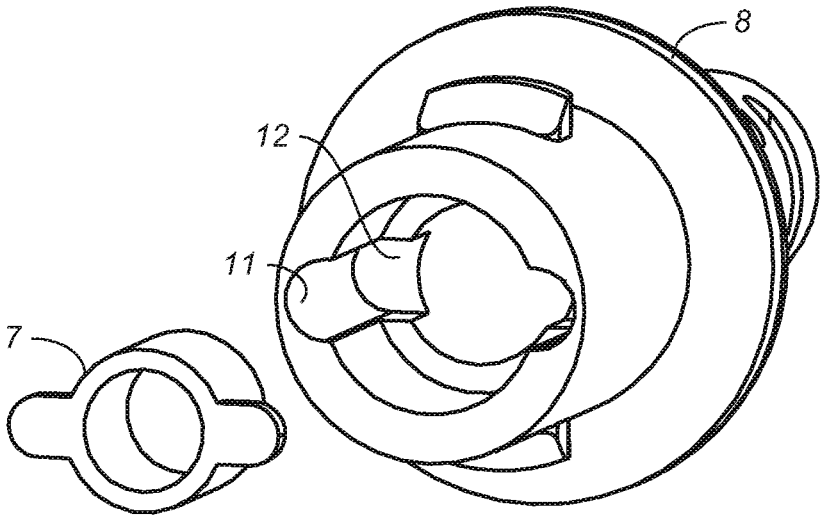
FIG. 5*a* illustrates the strain relief and rear housing of FIG. 3 shown to depict strain relief locking features, in accordance with an embodiment.
Figure 5B:
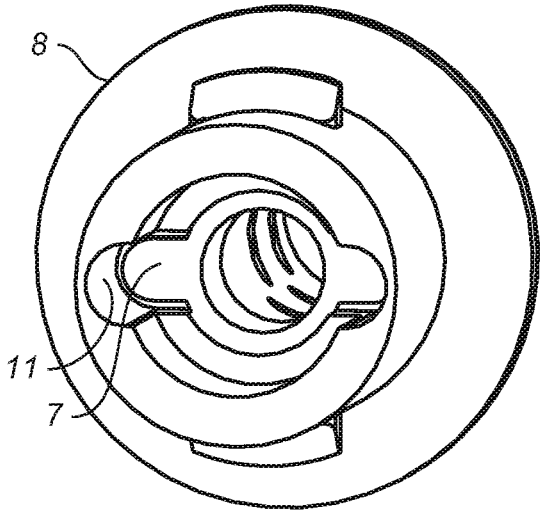
FIG. 5*b* illustrates the strain relief locking features of FIG. 5*a*, in accordance with an embodiment.

FIGS. 5*a* and 5*b* are detail views of strain relief 7 and rear housing 8 shown to depict the strain relief locking features 11 and 12, in accordance with an embodiment. FIG. 5*a* detail view of strain relief 7 and the rear housing 8 depicts a form fitted recess 11 in rear housing 8 into which strain relief 7 fits to prevent axial twisting, in accordance with an embodiment. At the bottom of the recess 11, there is a stop feature 12 which captures strain relief 7 and prevents it from being pulled past the stop feature 12 toward the cable exit point. FIG. 5*b* detail view shows strain relief 7 and rear housing 8, wherein strain relief 7 is in a seated position within rear housing 8, in accordance with an embodiment. Of note, FIGS. 5*a* and 5*b* show a snug/press fit relationship between the strain relief 7 and the recess 11, in accordance with an embodiment. In other embodiments, the relationship between the strain relief 7 and the recess 11 may be that of a snapping feature that allows the strain relief 7 to snap into the recess 11.

Figure 6A:
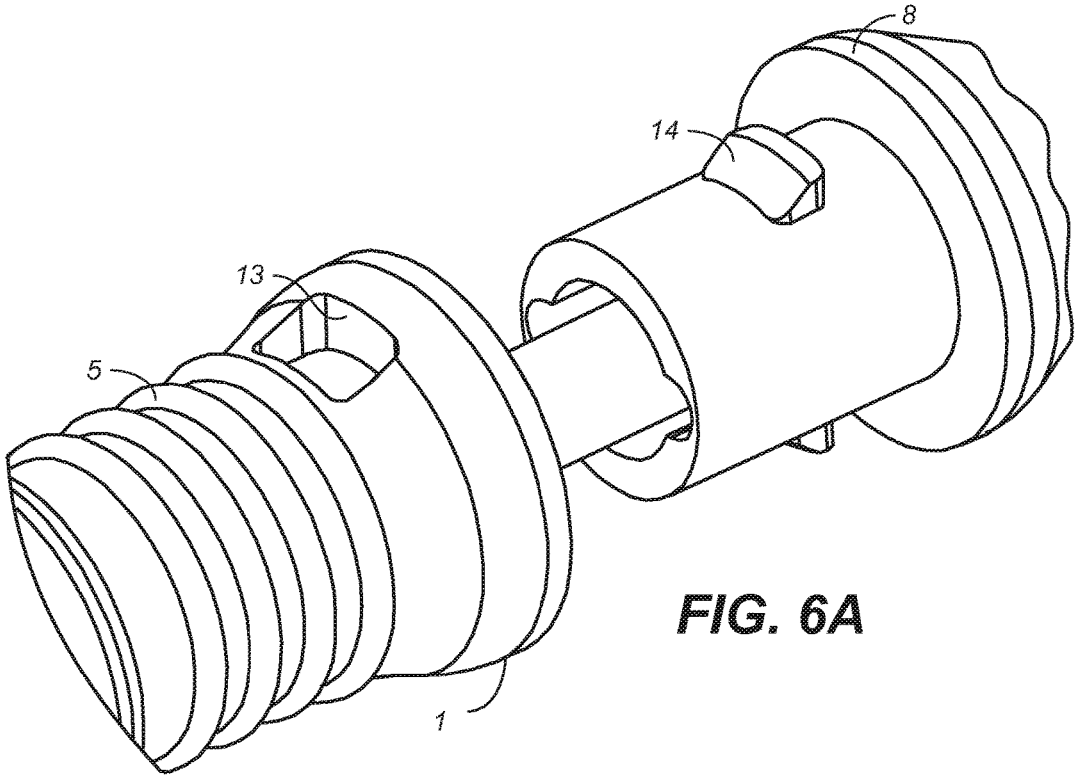
FIG. 6*a* illustrates the connector body and the rear housing shown to depict snap lock features that secures FIG. 1 assembly together as a final step in assembly, in accordance with an embodiment.
Figure 6B:
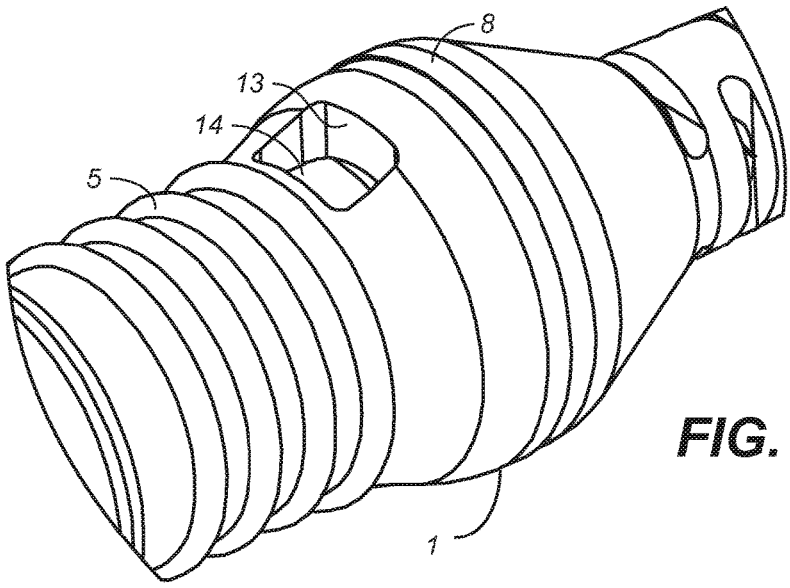
FIG. 6*b* illustrates the connector body and the rear housing shown to depict snap lock features that secures FIG. 1 assembly together as a final step in assembly, in accordance with an embodiment.

FIGS. 6*a* and 6*b* are detail views of the connector body 1 and the rear housing 8 shown to depict the snap lock feature 13 and 14 that secures FIG. 1 assembly together as a final step in assembly, in accordance with an embodiment.

As FIGS. 6*a* and 6*b* illustrate the final step in the assembly described herein, it can be seen that this assembly secures and interlocks internal components into place while also allowing movement of the retractable shroud 2 and the retractable shroud spring 5, in accordance with an embodiment.

The FIG. 6*a* detail view shows the connector body 1 snap feature receptacle 13 and the rear housing 8 male snap feature 14 in an open position prior to FIG. 6*b*, in accordance with an embodiment.

The FIG. 6*b* detail view shows connector body 1 snap feature receptacle 13 and the rear housing 8 male snap feature 14 in a closed position which is a final step of assembly, in accordance with an embodiment. In this closed position, the connector body 1 snap feature receptacle 13 and rear housing 8 male snap feature 14 lock internal components (2,5,6,7,10 of FIGS. 2 and 3) in place and prevent axial twisting and pulling of the internal components (2,5,6,7,10 of FIGS. 2 and 3) with respect to the forces applied to one conductor cable 9 of FIG. 2.

With reference to FIGS. 2, 3, 6*a* and 6*b*, when interlocked into a lock down position shown in FIG. 6*b*, a pressure is created that binds the complete component assembly housings together while restricting certain unwanted movements on the internal working components (the banana plug shaft 6 [It should be appreciated that the present invention also pertains to embodiments of banana plugs having a size other than 4 mms, including, but not limited to, 2 mm banana plugs and 3 mm banana plugs.], the strain relief 7, and the solder junction 10) as well as holding these internal components in their designated places. When the connector body 1 is snapped into the rear housing 8, a chain of contact points is created that connect all of the internal components into the functional assembly. This connection also provides pressure to close internal gaps in the inside cavity that might otherwise allow the 4 mm banana plug shaft 6 and the strain relief 7 to rotate, causing an undue stress and fatigue on the solder junction 10 which would result in complete plug failure. The combination of the two outer housings 1 and 8 allows the retractable shroud 2 to retract and extend as an electrical shield to protect the contact spring 4 which is secured on one end of the 4 mm banana plug shaft 6. The banana plug shaft 6 on the opposite end is where the electrical conductor that goes to the equipment is secured. This securing of the electrical conductor is often crimped or soldered into place and is vulnerable when rotated or pulled on. Wings are added onto the strain relief 7, in which the wings are pressed into a valley or valleys that contain conductor or cable movement when the assembly is locked into place. This, in conjunction with the flat edge feature 15 found on the 4 mm banana plug shaft 6 stop all possibilities of movement on the solder junction 10 or crimp joint on the electrical conductor. The 4 mm banana plug shaft 6 that presses the strain relief 7 into place also contains a ring that acts as a stop for the retractable shroud spring 5; this contains the spring and allows the retractable shroud 2 to slide up and down over the 4 mm banana plug shaft 6 to act as an insulator. The combination of the above mentioned components of the assembly creates a fail-proof system that would guarantee the user years of additional use and safety.

Example of embodiments, with reference to FIGS. 1-6*b* will be described as follows.

Some embodiments of a banana connector include: the connector body 1 configured for housing the banana plug shaft 6; a rear housing 8 configured for attaching to the first end 20 of the connector body 1 and for housing an intermediate portion 21 of a conductor cable 9, wherein the intermediate portion 21 is between the first end 22 and the second end 23 of the conductor cable 9; a solder junction 10 comprising the first end 22 of the conductor cable 9 being soldered to the banana plug shaft 6; a strain relief 7 configured for attaching to an interior of the rear housing 8; and a strain relief locking mechanism configured for holding to the intermediate portion 21 of the conductor cable 9 and securing the first end 22 of the conductor cable 9 in position, wherein the strain relief locking mechanism isolates movement of the second end 23 of the conductor cable 9 from the solder junction 10.

In one embodiment, the strain relief 7 is fixed into position within the rear housing 8 when the strain relief locking mechanism holds the intermediate portion 21 of the conductor cable 9 in place.

In one embodiment, the strain relief locking mechanism includes: a pinching mechanism configured for retainably (able to hold and maintain) pinching and deforming the intermediate portion 21 of the conductor cable 9.

In one embodiment, the banana plug shaft comprises: a locking feature configured to cooperate with a connector body locking feature such that the banana plug shaft 6 is fixed into position within the connector body 1.

Some embodiments further include: a retractable shroud 2 disposed on an exterior of the first end 23 of the connector body 1, wherein the retractable shroud 2 is spring loaded and covers exposed contact spring 4 when the banana connector is removed from a mating jack.

Some embodiments of the present technology include a system for containing a strain relief 7, the system comprising an assembly housing, the assembly housing comprising: a first outer housing comprising a connector body 1; a second outer housing comprising a rear housing 8, wherein the first outer housing snaps into the second outer housing and creates a chain of contact points that connect components internal to the assembly housing and prevents internal components from rotating, wherein the assembly housing houses within a banana plug shaft 6, a strain relief 7 and a solder junction 10, wherein the solder junction 10 solders a first end 22 of a conductor cable 9 to the banana plug shaft 6, wherein the first end 22 of the conductor cable 9 is disposed within the assembly housing, and wherein via the chain of contact points, the banana plug shaft 6 presses the strain relief 7 into place and prevents movement of the strain relief 7 and the solder junction 10.

While the foregoing is directed to certain embodiments, other and further embodiments may be implemented without departing from the scope of the present technology, and the scope thereof is determined by the claims that follow.

What I claim is:

1. A banana connector, comprising:

a connector body housing a banana plug shaft;

a rear housing coupled to a first end of the connector body and housing an intermediate portion of a conductor cable, wherein the intermediate portion is between a first end and a second end of the conductor cable;

a solder junction comprising a first end of the conductor cable being soldered to the banana plug shaft;

a strain relief coupled to an interior of the rear housing; and a strain relief locking mechanism, distinct from said strain relief, preventing rotation of the banana plug shaft with respect to the connector body and coupled to the intermediate portion of the conductor cable and securing the first end of the conductor cable in position, wherein the strain relief locking mechanism is coupled to said strain relief and isolates movement, occurring at the second end of the conductor cable, from the solder junction.

2. The banana connector of claim 1, further comprising:

a retractable shroud disposed on an exterior of the first end of the connector body, wherein the retractable shroud is spring loaded and covers an exposed contact when the banana connector is removed from a mating jack.

3. The banana connector of claim 1, wherein the strain relief is fixed into position within the rear housing when the strain relief locking mechanism holds the intermediate portion of the conductor cable in place.

4. The banana connector of claim 1, wherein the strain relief locking mechanism comprises:

a pinching mechanism retainably pinching and deforming the intermediate portion of the conductor cable.

5. The banana connector of claim 1, wherein the banana plug shaft comprises:

a locking feature coupled to a connector body locking feature such that the banana plug shaft is fixed into position within the connector body.

6. The banana connector of claim 1, wherein the connector body of the banana plug shaft is coupled to the rear housing via a rear housing snap lock feature and a connector body snap lock feature.

7. A system for containing a strain relief, the system comprising an assembly housing, the assembly housing comprising:

a first outer housing comprising a connector body; and a second outer housing comprising a rear housing, wherein the first outer housing snaps into the second outer housing and creates a chain of contact points that connect components internal to the assembly housing and prevents internal components from rotating, wherein the assembly housing houses within a banana plug shaft, a strain relief, a strain relief locking mechanism distinct from said strain relief, and a solder junction, wherein the solder junction solders a first end of a conductor cable to the banana plug shaft, wherein the first end of the conductor cable is disposed within the assembly housing, and wherein via the chain of contact points, the banana plug shaft presses the strain relief locking mechanism into place and prevents rotational movement of the strain relief and, hence, isolates movement, occurring at a second end of the conductor cable, from the solder junction.

* * * * *